US005466010A

United States Patent [19]

Spooner

[11] Patent Number: 5,466,010

[45] Date of Patent: Nov. 14, 1995

[54] CARDS USED AS BOTH COUPONS AND PLAYING CARDS AND THEIR METHOD OF MANUFACTURE AND USE

[76] Inventor: James J. Spooner, 16203 E. Glendora Dr., Fountain Hills, Ariz. 85268-3108

[21] Appl. No.: 169,979

[22] Filed: Dec. 17, 1993

[51] Int. Cl.[6] ..... B42D 15/00

[52] U.S. Cl. ..... 283/67; 283/56; 273/294; 273/308

[58] Field of Search ..... 283/56, 67, 117; 273/292, 294, 297, 308, 307; D21/42–47

[56] References Cited

U.S. PATENT DOCUMENTS

| | | | |
|---|---|---|---|
| D. 9,011 | 2/1876 | Duthie | D21/42 |
| D. 9,158 | 3/1876 | Duthie | D21/42 |
| D. 59,757 | 11/1921 | Laver | D21/45 |
| D. 81,336 | 6/1930 | Joseph | 273/294 |
| D. 126,404 | 4/1941 | Nussgruber | D21/45 |
| 266,444 | 10/1882 | Dreyfuss | 273/296 |
| 1,143,042 | 6/1915 | Davis | 273/297 |
| 1,320,899 | 11/1919 | McIntire | D21/42 |
| 1,409,348 | 3/1922 | Le Roy | 283/56 |
| 2,214,952 | 9/1940 | Carothers | 273/308 |
| 3,334,806 | 8/1967 | Hiersteiner | 283/56 |
| 4,617,215 | 10/1986 | Telesco | 283/56 |

OTHER PUBLICATIONS

Entertainment Coupon Book, Entertainment Publications, Inc., 1993, Phoenix, Ariz.

*Primary Examiner*—Hwei Siu Payer
*Attorney, Agent, or Firm*—Donald J. Lisa

[57] ABSTRACT

A plurality of cards, usable as both coupons and playing cards. Each card has a playing card indicia and a coupon message printed on one of its faces. The set of cards is a compilation of coupons in which each coupon is redeemable for valuable goods or services. The coupon playing cards may have a round, casino chip design. The design of the card aids in the promotion of the set of cards and the discounts offered in the cards to a number of consumers.

19 Claims, 2 Drawing Sheets

CARDS USED AS BOTH COUPONS AND PLAYING CARDS AND THEIR METHOD OF MANUFACTURE AND USE

BACKGROUND OF THE INVENTION

1. Fields of the Invention

The present invention relates generally to playing cards and coupons, and more particularly, to a set of cards used as both coupons and playing cards. The invention further relates to the method of making cards usable as both coupons and playing cards.

2. Discussion of Background and Prior Art

Playing cards are commonly used by individuals to play various card games, such as poker, blackjack, gin rummy, bridge, and many other playing card games. Playing cards can be made to have various shapes and designs. Some common shapes of playing cards are rectangular, round, oval, and square.

A playing card is typically designed with a playing card indicia, such as the suit (i.e. spades, diamonds, clubs, or hearts), and a card number (i.e. 1, 2, 3, 4, 5, 6, 7, 8, 9, 10, J, Q, K or A), which are both printed on a front face of the card. The back face of a playing card does not have any special design. A number of designs may be printed on the back faces of the playing cards, and the same picture or design is typically used on the back faces of all the playing cards of a set so that they are uniform. The picture or design is mainly aesthetic in nature.

In the past playing cards have had advertisements printed on at least one face of the card. Vendors have placed these advertisements on playing cards to promote their goods or services to various users of the playing cards. The goal of the vendors in this instance would be to effectively advertise by familiarizing players with the advertisements through the use of these cards so as to influence consumers to later purchase their goods or services.

Key differences between advertisements and coupons do in fact, exist. As stated earlier, advertisements are used for encouraging consumers to later purchase the various promoted goods or services themselves. Coupons, on the other hand, are used for promoting and encouraging consumers to go to vendor locations and redeem the coupons for the value of the coupon itself in kind or as a discount on more valuable goods or services. Therefore, the fundamental difference between advertisements and coupons is that advertisements do not have any redeeming value while coupons do since they are exchangeable for value. Presently, however, a set of cards usable as both coupons and playing cards that have coupon messages printed on a face of each of the cards does not exist in the market.

For several years, marketing groups and companies have compiled and made books of coupons, (i.e. "entertainment books"), which were sold to various consumers for a price (i.e. typically $30.00–$50.00). These books contain many coupons in which various merchants offered a number of goods or services at a discount. The marketing group would compile these books by obtaining agreements between various vendors to give or render discounts on various goods or services in exchange for the marketing group promoting the discounts by printing the discount information in coupon form into these books. Consumers that purchased these books would benefit from the discounts being offered by the various vendors.

In the past, most marketing groups have compiled this information in a book form in which the coupons were torn out of the book at the time the consumers were to use them. Presently, however, a set of coupons, which have been compiled in the form of playing cards or a deck of playing cards, does not exist in the market. Additionally, a set of coupons printed in the form of playing cards to be used to further promote and market the goods or services that are being offered by the cards also does not exist on the market.

In overcoming the problems and limitations of the prior art, it is an object of the present invention to provide a plurality of cards usable as both coupons and playing cards so that the cards are redeemable for valuable goods or services.

It is another object of the invention to provide a plurality of cards usable as both coupons and playing cards that are round.

It is still another object of the invention to provide a plurality of cards usable as both coupons and playing cards that make up a complete deck of cards.

It is still another object of the invention to provide a plurality of cards usable as both coupons and playing cards that make up a set of coupons.

It is a further object of the present invention to provide a set of cards that are coupons for goods or services related to casinos.

It is still a further object of the present invention to provide a set of cards that is designed to promote the goods or services being offered at a discount.

It is still a further object of the present invention to provide a set of cards designed to have the shape of a round, flat, casino chip.

SUMMARY OF THE INVENTION

Set forth below is a brief summary of the invention in order to solve the foregoing problems and achieve the foregoing and other objects, benefits, and advantages in accordance with the purpose of the present invention as embodied and broadly described herein.

One aspect of the invention is a plurality of cards usable as both coupons and playing cards, wherein each playing card includes a front face with at least one playing card indicia, a back face, and a coupon message printed on at least one of the faces of the cards describes the cards as redeemable for valuable goods or services.

Another feature of this aspect of the invention is that the coupon playing cards have the shape of a round, flat casino chip.

Another feature of this aspect of the invention is that the plurality of cards is a complete deck of cards.

Another feature of this aspect of the invention is that the plurality of cards is a set of coupons.

A second aspect of the invention is a set of cards having playing card indicias and coupon messages from a number of vendors for allowing the cards to be redeemable for a number of goods or services.

DETAILED DESCRIPTION OF THE INVENTION

Figure 1:
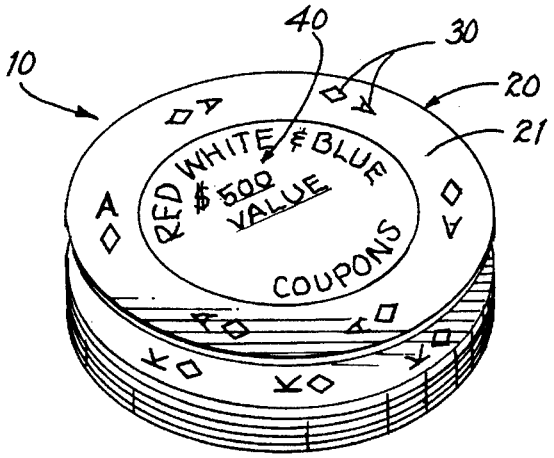
FIG. 1—Perspective view of a preferred embodiment of a plurality of round cards usable as both coupons and playing cards.
Figure 6:
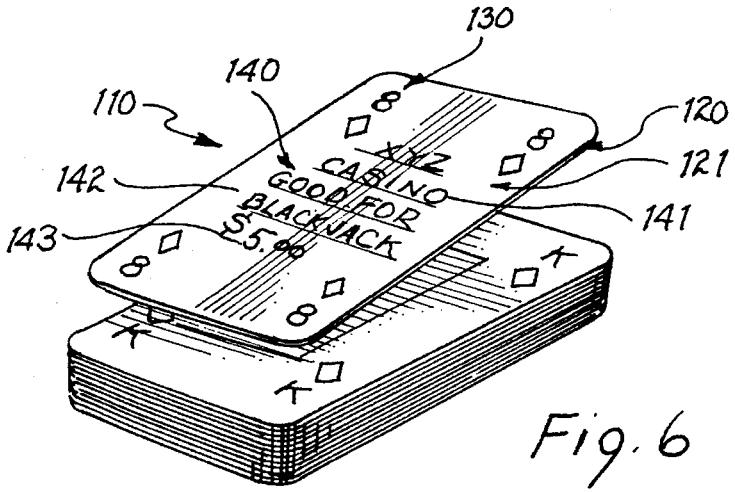
FIG. 6—Perspective view of a second embodiment plurality of rectangular cards usable as both coupons and playing cards.

FIGS. 1 and 6 respectively show perspective views of a first and preferred embodiment plurality of cards 10 and a second embodiment plurality of cards 110. The two embodiments are designed so that the cards are usable as both coupons redeemable for valuable goods or services and playing cards for playing various card games. These two embodiments are now described in more detail.

The First Embodiment

Figure 2:
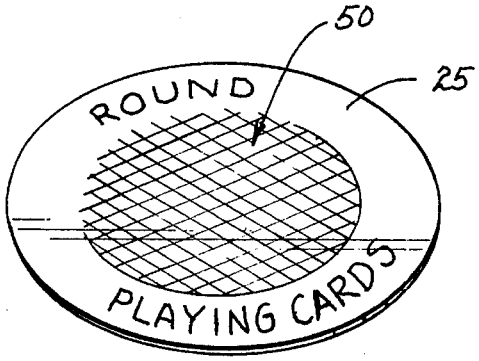
FIG. 2—Perspective view of the back face of a round card usable as both a coupon and a playing card.

As seen in FIG. 1, a preferred embodiment plurality of cards 10 includes a number of individual coupon playing cards 20. As seen in FIGS. 1 and 2, each coupon card 20 has a front face 21, a back face 25, playing card indicias 30, coupon message 40, and a back face design 50. Playing card indicia 30 indicate the suit of the card (i.e. spades, diamonds, clubs or hearts) and the number of the card (i.e. 1, 2, 3, 4, 5, 6, 7, 8, 9, 10, J, Q, K or A). The plurality of cards 10 usable as both coupons and playing cards is designed as a complete deck of cards so that it can be used like any other normal deck of playing cards.

The face 25 of a card 20 includes a back face design 50. The back face design 50 may be designed to be any type of picture or design. Each card 20 has the same back design 50 in a plurality of cards 10 so that all back faces of cards 20 are uniform, and the plurality of cards 10 can, therefore, be used as a normal deck of playing cards (i.e. without any "marked cards" problem).

Each card 20 also has a coupon message 40 printed on one of its faces. As shown in FIGS. 1 and 3–5, coupon message 40 is preferably printed on the front face 21 and not on the back face 25 of each card 20 so that the back faces 25 remain uniform, and the cards 20 are still usable as normal playing cards (i.e. a player could memorize the coupon that correlates to a particular playing card, and the players would, in effect, be playing with marked cards).

Figure 3:
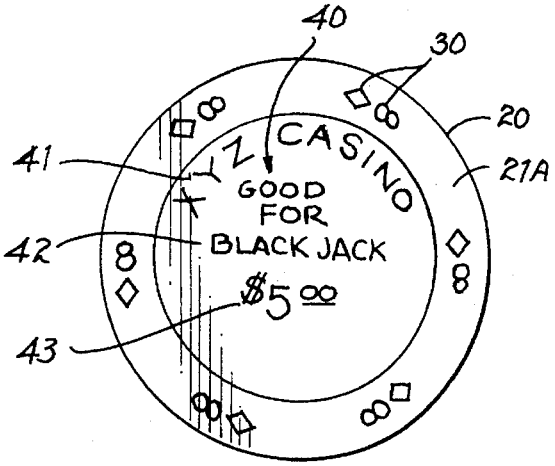
FIG. 3—Plan view of the front face of a round card usable as both a coupon and a playing card having a coupon message related to casino goods or services.
Figure 4:
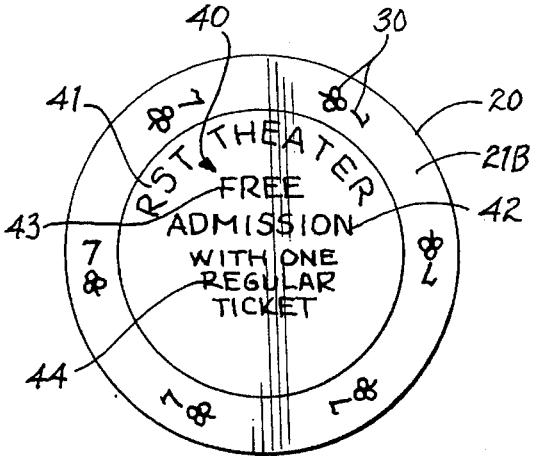
FIG. 4—Plan view of the front face of a round card usable as both a coupon and a playing card having a coupon message related to theater or show admissions.
Figure 5:
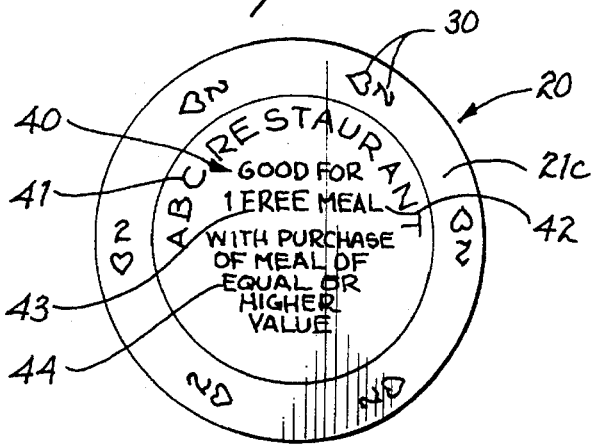
FIG. 5—Plan view of the front face of a round card usable as both a coupon and a playing card having a coupon message related to restaurant goods or services.

As shown in FIGS. 3–5, coupon message 40 includes an identification of the name 41 of the vendor offering the discount, the type of good or service 42 that is being offered at a discount, and the value amount 43 of the coupon for card 20. Coupon message 40 may further include any other information 44 such as conditions, restrictions, and limitations that apply to the coupon offer.

Marketing groups compile information for a number of coupon messages 40 by obtaining agreements with a number of vendors who agree to offer discounts on a number of types of goods or services. The goods or services can be any type such as entertainment, travel, or accommodation services. In exchange for these offers by vendors, the marketing group will promote the discounted goods or services in a plurality of cards 20. For example, in FIG. 3, the front face 21A of card 20 shows XYZ casino offering $5.00 to a consumer for playing blackjack, and in FIG. 4, the front face 21B of card 20 shows RST theater offering a free admission to a show with the purchase of a regular admission ticket. Another example is in FIG. 5 where the front face 21C of card 20 shows ABC restaurant offering a free meal when the consumer purchases a meal of equal or higher value.

As shown in FIGS. 3–5, the cards 20 are coupons redeemable for discounted valuable goods or services. These cards 20 may be redeemed by either the consumer exchanging them with the vendors for the offered goods or services, or preferably, by the consumer presenting the card to the vendors for obtaining the good or service and then the vendors invalidating them as coupons when the good or service has been provided so that the consumer can retain the card (i.e. stamp the word "void" or "used" on the face of the coupon so that the consumer is able to keep the card 20 and still maintain a complete deck of cards that can be used as playing cards).

The plurality of cards 10 are designed to have promotion and marketing features and advantages. The cards 20 are compiled by the marketing group as a set of coupon cards, and this set of coupons is similar to an entertainment book of coupons. The marketing group compiles this set of coupon cards in the same way they would compile an entertainment book, that is, by obtaining agreements between various vendors to give or render discounts on various goods or services in exchange for the marketing group promoting the discounts by printing the coupons into these sets of cards. The marketing group, therefore, sells the set of coupon cards for a certain price (i.e. $30.00–$50.00) which is substantially below the total value of all coupons (i.e. $500.00) to various consumers who wish to purchase them, and the consumers have the benefit of various discounted goods or services. Therefore, cards 20 are designed in a way so that the set of cards and the discounts offered in the cards on goods or services are promoted to a number of consumers who are thereby induced to go to a particular casino or vendor redeems the coupon.

Figure 2A:
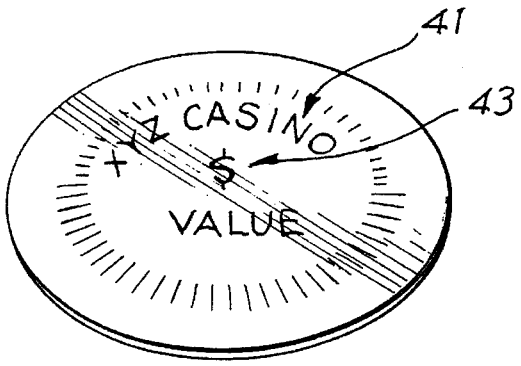
FIG. 2A—Perspective view of the back face of a card designed in the shape of a flat, round casino chip.

In FIGS. 2A and 3, card 20 is designed to be a round, flat, casino chip so that it has the special feature of promoting casino goods or services. The card 20 has the name of the casino vendor 41, the type of casino good or service 42, and the value amount 43 of the coupon for card 20. Card 20 includes a value that is printed as part of its casino chip design, and this value may correspond to value amount 43 of the coupon for card 20.

The Second Embodiment

Figure 7:
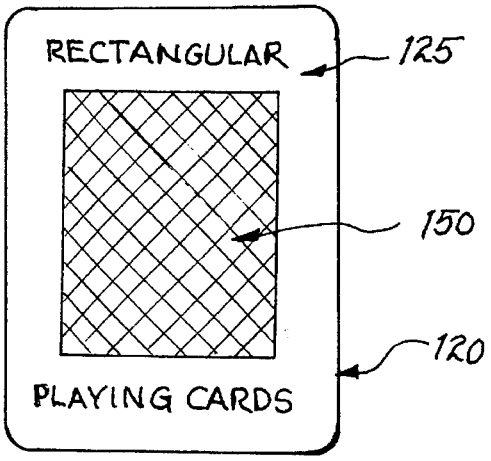
FIG. 7—Plan view of the back face of a rectangular card usable as both a coupon and a playing card.

As seen in FIGS. 6 and 7, a second embodiment 110 of the plurality of rectangular cards 10 also includes a number of individual rectangular cards 120. As shown in FIGS. 6 and 7, each rectangular card 120 has a front face 121, a back face 125, playing card indicia 130, coupon message 140, and a back face design 150. Playing card indicia 130 indicate the suit of the card (i.e. spades, diamonds, clubs, or hearts) and the card numbers (i.e. 1, 2, 3, 4, 5, 6, 7, 8, 9, 10, J, Q, K or A). As shown in FIG. 7, the back face 125 of the card 120 has back face design 150.

In FIG. 6, coupon message 140 includes the name 141 of the vendor offering the discount, the type of goods or services 142 that is being offered at a discount, and the value amount 143 of the coupon card 120. Other than differences in design, the second embodiment plurality of cards 120 are used in the same manner and more or less have the same advantages and features as the first embodiment plurality of coupon cards 20, which was discussed in detail earlier.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of using a plurality of cards as both a playing card set and a coupon set wherein each card has printed on a face thereof a coupon message from a vendor and at least one playing card indicia for allowing the card to be presentable by a consumer for a type of good or service and to be used as a playing card, comprising the steps of:

using each card as a playing card according to the playing card indicia printed on the face of the card; and presenting each card to the vendor for obtaining the type of good or service according to the coupon message printed on the face of the card; and wherein the step of presenting each card further comprises the step of invalidating the card as a coupon when the good or service has been provided by the vendor so that the consumer can still retain the card for use as a playing card.

2. A method of making a plurality of cards usable as both coupons and playing cards, comprising the steps of:

providing a plurality of cards wherein each card has a playing card indicia printed on a front face for allowing the card to be used as a playing card;

compiling a number of coupon messages from at least one vendor of goods or services; and printing a coupon message on at least one of the faces of each card describing the card as presentable for a type of valuable good or service.

3. The method of making a plurality of coupon playing cards according to claim 2 wherein the step of compiling coupon messages further comprises the step of:

obtaining the coupon message from at least one vendor who is willing to offer at least one valuable good or service in exchange for redeeming the card as a coupon.

4. The method of making a plurality of coupon playing cards according to claim 2 wherein the step of printing a coupon message further comprises the step of:

printing a message on the card which states that the card may be redeemed by exchanging it with the vendor for the valuable good or service.

5. The method of making a plurality of coupon playing cards according to claim 2 wherein the step of printing the coupon message further comprises the step of:

printing a message on the card which states that the card may be redeemed upon presentment of it to the vendor for obtaining the valuable good or service only if the card has not been invalidated.

6. A plurality of cards usable as both coupons and playing cards, wherein each card comprises:

a front face having at least one playing card indicia printed thereon for allowing the card to be used as a playing card;

a back face; and a coupon message printed on at least one of the faces describing the card as presentable as a coupon for a type of valuable good or service.

7. The plurality of cards according to claim 6 wherein:

the cards are round.

8. The plurality of cards according to claim 7 wherein:

one of said faces of each round playing card has a casino chip design.

9. The plurality of cards according to claim 6 wherein:

the cards make up a complete deck of playing cards.

10. The plurality of cards according to claim 6 wherein:

the cards are a compilation of coupons.

11. The plurality of cards according to claim 6 wherein:

the coupon message of a card relates to redeeming the card for an entertainment type good or service.

12. The plurality of cards according to claim 11 wherein:

the entertainment type good or service described in the printed coupon message is related to casinos.

13. The plurality of cards according to claim 6 wherein:

the coupon message relates to redeeming the card for a travel type good or service.

14. The plurality of cards according to claim 6 wherein:

the coupon message relates to redeeming the card for an accommodation type good or service.

15. A set of cards usable as both coupons and playing cards, comprising:

a plurality of cards wherein the cards have printed on their faces a plurality of playing card indicia and a plurality of coupon messages from a number of vendors identifying the cards as presentable for a number of goods or services.

16. The set of cards according to claim 15 wherein:

the plurality of cards are designed in the shape of a round, flat casino chip.

17. The set of cards according to claim 16 wherein:

each card in the plurality of cards has a value printed on a face of a card as part of the casino chip design which corresponds to the value of a discount being offered for the good or service printed in the coupon message.

18. The set of cards according to claim 15 wherein the coupon messages each comprise:

an identification of the vendor;

an identification of the good or service being offered at a discount; and an identification of an amount of the discount for the good or service.

19. The set of cards according to claim 15 wherein:

the number of vendors are solely casinos.

* * * * *